US007748777B2

(12) United States Patent
Park et al.

(10) Patent No.: US 7,748,777 B2
(45) Date of Patent: Jul. 6, 2010

(54) COLLAPSIBLE SUPPORT FRAME FOR FURNITURE

(75) Inventors: Frederick K. Park, 4008 Capital Dr., Rocky Mount, NC (US) 27804; Paul Bradley Forrest, Cary, NC (US)

(73) Assignee: Frederick K. Park, Rocky Mount, NC (US)

( * ) Notice: Subject to any disclaimer, the term of this patent is extended or adjusted under 35 U.S.C. 154(b) by 0 days.

(21) Appl. No.: 12/115,920

(22) Filed: May 6, 2008

(65) Prior Publication Data

US 2008/0203804 A1 Aug. 28, 2008

Related U.S. Application Data

(63) Continuation-in-part of application No. 11/414,326, filed on Apr. 28, 2006, now Pat. No. 7,384,097.

(51) Int. Cl.
*A47C 1/12* (2006.01)

(52) U.S. Cl. ..... 297/45; 297/16.1; 297/16.2

(58) Field of Classification Search ..... 297/45, 297/16.1, 16.2
See application file for complete search history.

(56) References Cited

U.S. PATENT DOCUMENTS 615,476 A * 12/1898 Chapman ..... 297/45 X
647,171 A * 4/1900 Wiles ..... 248/164 X
933,285 A * 9/1909 Blair ..... 15/104.16
1,348,145 A * 8/1920 Arden ..... 15/104.165
2,705,015 A * 3/1955 Langlais ..... 52/632
3,203,285 A * 8/1965 Schmidt ..... 81/177.6
3,730,544 A * 5/1973 Hyman ..... 280/819
RE28,067 E * 7/1974 Hyman ..... 135/74
4,167,354 A * 9/1979 Walker ..... 403/109.7
4,184,711 A * 1/1980 Wakimoto ..... 297/16.2
4,215,877 A * 8/1980 Pritchett ..... 280/652
4,236,711 A * 12/1980 Klingbeil ..... 472/72
4,539,786 A * 9/1985 Nelson ..... 52/645
4,547,015 A * 10/1985 Wakimoto ..... 297/16.2
4,706,696 A * 11/1987 Gillis ..... 135/127
4,827,958 A * 5/1989 Cantwell et al. ..... 135/127
4,934,638 A * 6/1990 Davis ..... 248/164
5,496,094 A * 3/1996 Schwartzkopf et al. ..... 297/45
5,709,428 A * 1/1998 Hugghins ..... 297/16.2
5,851,052 A * 12/1998 Gustafsson ..... 297/16.2

(Continued)

FOREIGN PATENT DOCUMENTS

JP 06245840 A * 9/1994

*Primary Examiner*—Rodney B White
(74) *Attorney, Agent, or Firm*—Coats & Bennett, P.L.L.C.

(57) ABSTRACT

A collapsible support frame includes a plurality of segmented legs pivotally connected to an inner surface of a collar, and are held together by an elastic cord. The legs pivot between a folded and a deployed position. In the folded position, the legs segments form a bundle to facilitate storage or transport. Portions of the legs segments may seat within leg seats formed in the outer surface of the collar. In the deployed position, the legs pivot to contact leg support seats formed at angles in an inner surface of the collar. After contact, each leg extends in a different direction supported by its respective leg support seat. The elastic cord provides tension that keeps the leg segments together in the deployed position, and prevents the leg segments from becoming lost or separated in the folded position.

19 Claims, 8 Drawing Sheets

U.S. PATENT DOCUMENTS 5,876,091 A * 3/1999 Chernomashentsev ..... 297/16.2
5,921,621 A * 7/1999 Cook et al. ..... 297/16.2
5,930,971 A * 8/1999 Etheridge ..... 52/646
5,975,626 A * 11/1999 Aycock ..... 297/16.1
6,038,802 A * 3/2000 Tidwell ..... 40/610
6,045,177 A * 4/2000 Grace ..... 297/45
6,062,648 A * 5/2000 Adler ..... 297/45 X
6,135,557 A * 10/2000 Gustafsson ..... 297/16.2 X
6,270,156 B1 * 8/2001 Metzger et al. ..... 297/16.2
6,296,304 B1 * 10/2001 Zheng ..... 297/45
6,378,168 B1 * 4/2002 Brady et al. ..... 16/110.1
6,557,572 B2 * 5/2003 Lah ..... 135/114
6,634,704 B1 * 10/2003 Bergquist ..... 297/16.2
6,679,644 B1 * 1/2004 Heller ..... 403/220
6,682,135 B2 * 1/2004 Zheng ..... 297/16.2
6,702,371 B2 * 3/2004 Zheng ..... 297/16.2
6,755,462 B2 * 6/2004 Zheng ..... 297/16.2
6,799,797 B2 * 10/2004 Cochran et al. ..... 297/16.2
6,871,905 B2 * 3/2005 Grace ..... 297/16.2
7,384,097 B2 * 6/2008 Park et al. ..... 297/45
2002/0117878 A1 * 8/2002 Fox ..... 297/16.2
2007/0013211 A1 * 1/2007 Crowell ..... 297/16.2

* cited by examiner

COLLAPSIBLE SUPPORT FRAME FOR FURNITURE

RELATED APPLICATIONS

This application is a Continuation-In-Part application of, and claims priority from, U.S. patent application Ser. No. 11/414,326 filed Apr. 28, 2006. The '326 application, which is entitled "Collapsible Support Frame For Furniture," is incorporated herein by reference in its entirety.

TECHNICAL FIELD

The present invention relates generally to collapsible frame structures, and more particularly to collapsible frame structures comprising a plurality of separable frame members held together by an internal cord or cable.

BACKGROUND

Collapsible frame structures comprising a plurality of frame members that are joined end-to-end and held together by a flexible cord or cable are known. For example, U.S. Pat. Nos. 6,557,572; 4,827,958; 4,706,696 disclose tent poles comprising pole sections held together by an elastic cord. The individual pole sections can be separated and folded over to form a compact bundle for storage. The elastic cord pulls the individual frame members together to facilitate assembly. Similar frame systems may be found in other types of devices as shown by U.S. Pat. Nos. 6,038,802 (portable displays); 4,215,877 (folding utility carts); and 6,062,648 (folding chairs). Frame structures that rely on an elastic cord to hold the individual sections together are often times cumbersome to assemble. Further, they are limited in the loads that can be supported.

SUMMARY

The present invention relates to a collapsible support frame comprising a plurality of segmented legs pivotally connected to an inner surface of a collar, and held together by an elastic cord. The legs are pivotable between a folded position and a deployed position and attach to the interior of the collar at respective pivot points. In the folded position, the legs segments are folded into a bundle to facilitate storage or transport, for example. Portions of the legs segments may seat within leg seats formed in the outer surface of the collar. In the deployed position, the legs pivot about respective pivot axes until they contact leg support seats formed at angles in an inner surface of the collar. After contact, each leg extends in a different direction and is supported by its respective leg support seat. The elastic cord provides tension that keeps the leg segments together in the deployed position, and prevents the leg segments from becoming lost or separated in the folded position.

In one embodiment, the inner surface of the collar comprises one or more integrally formed stops proximate each leg support seat. The stops may be formed in pairs, for example, and are positioned such that each pair is associated with a corresponding leg. Particularly, one stop of each pair is disposed on one side of a corresponding leg, while the other stop of each pair is disposed on the other side of the leg. Additionally, the stops are also formed such that one of the stops is above the pivot axis for the leg while the other stop is below the pivot axis for the leg. The stops are configured to prevent their corresponding leg segments from pivoting beyond a predetermined point when the leg segments are folded into a bundle.

DETAILED DESCRIPTION

Figure 1:
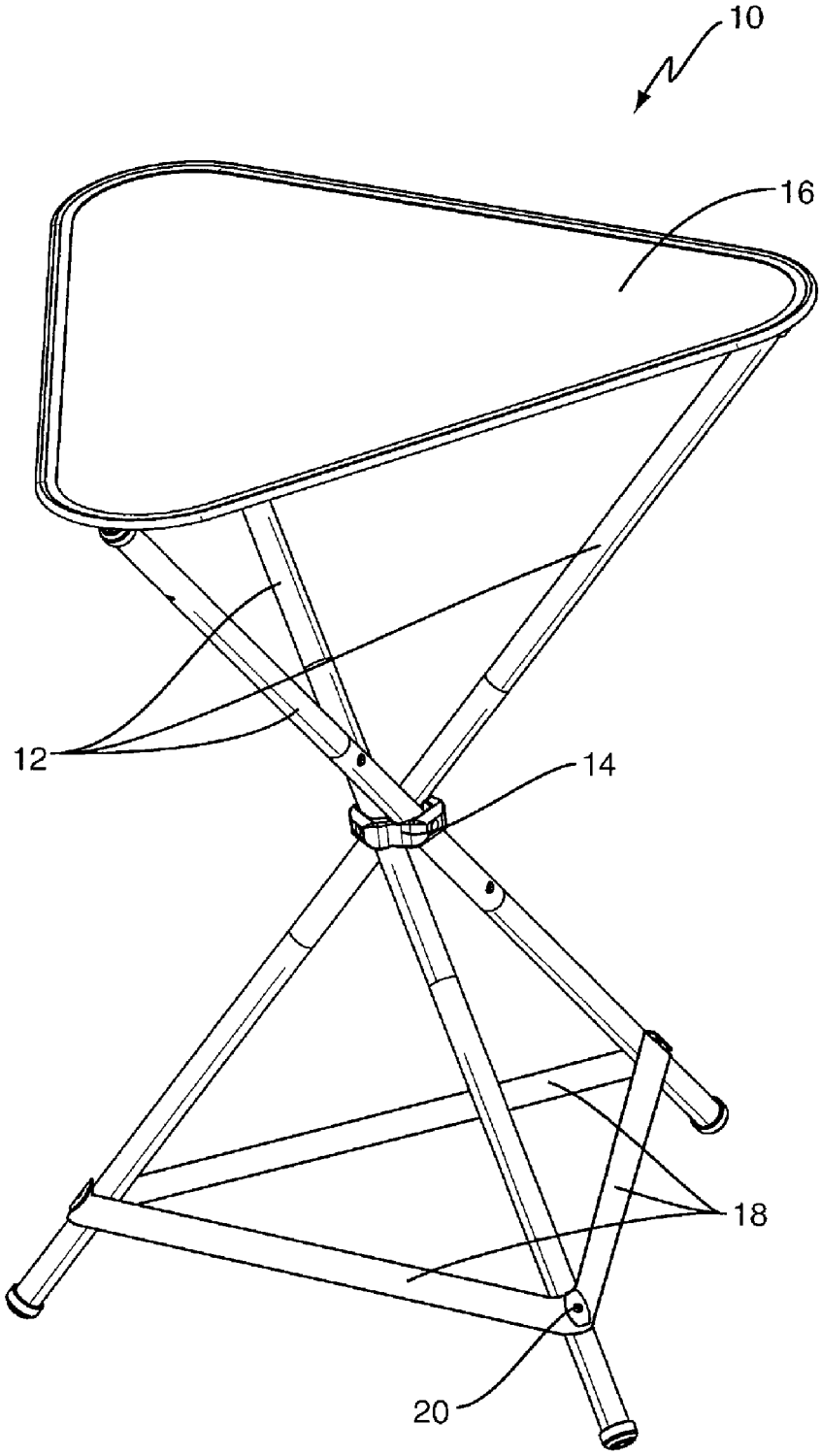
FIG. 1 illustrates a collapsible support frame according to one embodiment of the present invention in a deployed position.

Referring now to the drawings, the figures illustrate an exemplary collapsible support frame indicated generally by the numeral 10. In the disclosed embodiment, the support frame 10 is used for a collapsible stool. The support frame 10 is configured to facilitate folding and deployment of the stool. In a deployed position (FIG. 1), the support frame 10 is open and capable of withstanding a load such as a person's weight. In a folded position (FIG. 3), the support frame 10 forms a bundle for storage or carrying.

FIG. 1 illustrates one embodiment of a deployed support frame 10. The support frame 10 comprises three legs 12 joined together at an intermediate point by a collar 14. As described in more detail below, the collar 14 joins the legs 12 together at a suitable angle relative to one another. A piece of flexible material 16 extending between the legs 12 at one end of the support frame 10 forms a seat for the user. The material may comprise, for example, a flexible nylon fabric fixedly attached to the ends of the legs 12. At the opposite end of the support frame 10, a flexible strap 18 extends between each leg 12. The flexible strap 18 attaches to each leg 12 at points spaced from an underlying support surface using mechanical fasteners 20 such as rivets or screws. The flexible strap 18 provides stability to the support frame 10 by preventing the legs from overextending past a fully open position.

Figure 2:
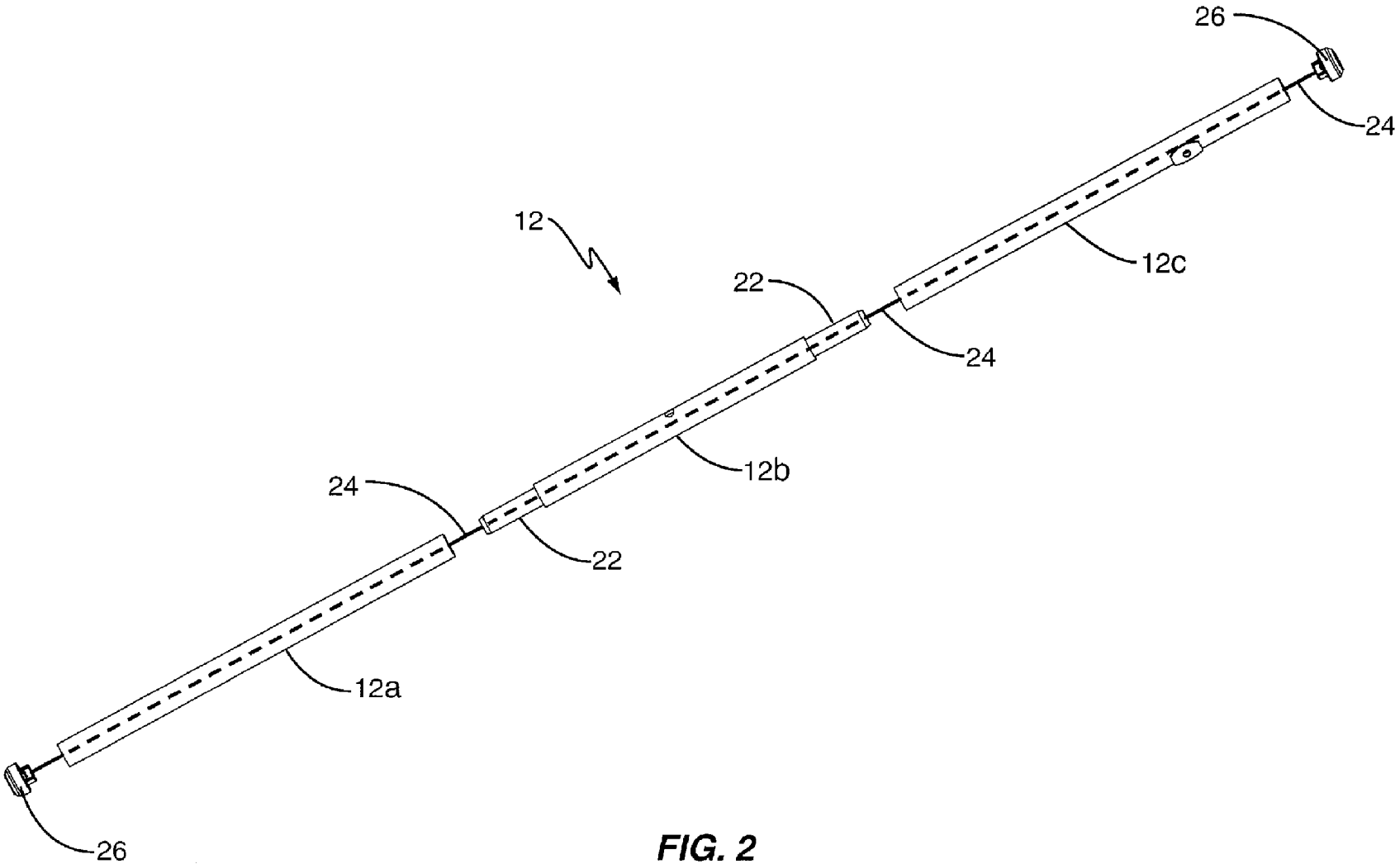
FIG. 2 illustrates a segmented leg of a collapsible support frame according to one embodiment of the present invention.

FIG. 2 illustrates an exploded view of an exemplary leg 12 in more detail. Those skilled in the art will appreciate that each leg 12 is substantially the same, and thus, only a single leg 12 is shown here for clarity. In this embodiment, each leg 12 comprises three hollow, tubular segments 12*a-c*. Each segment 12*a*-12*c* may be constructed of a sturdy, lightweight metal or metal alloy such as aluminum. An intermediate segment 12*b* includes a tubular extension 22 at each end. The extensions 22 may be integrally formed with segment 22 or press fit into the ends of segment 12*b*. The extensions 22 are sized to fit within the ends of adjacent segments 12*a*, 12*c* to facilitate assembly in an end-to-end manner with those adjacent segments 12*a*, 12*c*.

An elastic cord 24 such as a bungee cord, for example, extends interiorly through each segment 12*a-c*. The opposing ends of the elastic cord 24 are bound to respective end caps 26 sized to fit within the open ends of segments 12*a*, 12*c*. The elastic cord 24 facilitates assembly of the support frame 10 by pulling the individual segments 12*a-c* together. Particularly, the tendency of the elastic cord 24 is to retract. This pulls the individual segments 12*a-c* together such that the extensions 22 insert into the ends of the adjacent segments 12*a*, 12*c*. The elastic cord 24 also holds the individual segments 12*a-c* loosely together when the support frame 10 is folded for storage or transport so that the parts will not be separated and lost.

Figure 3:
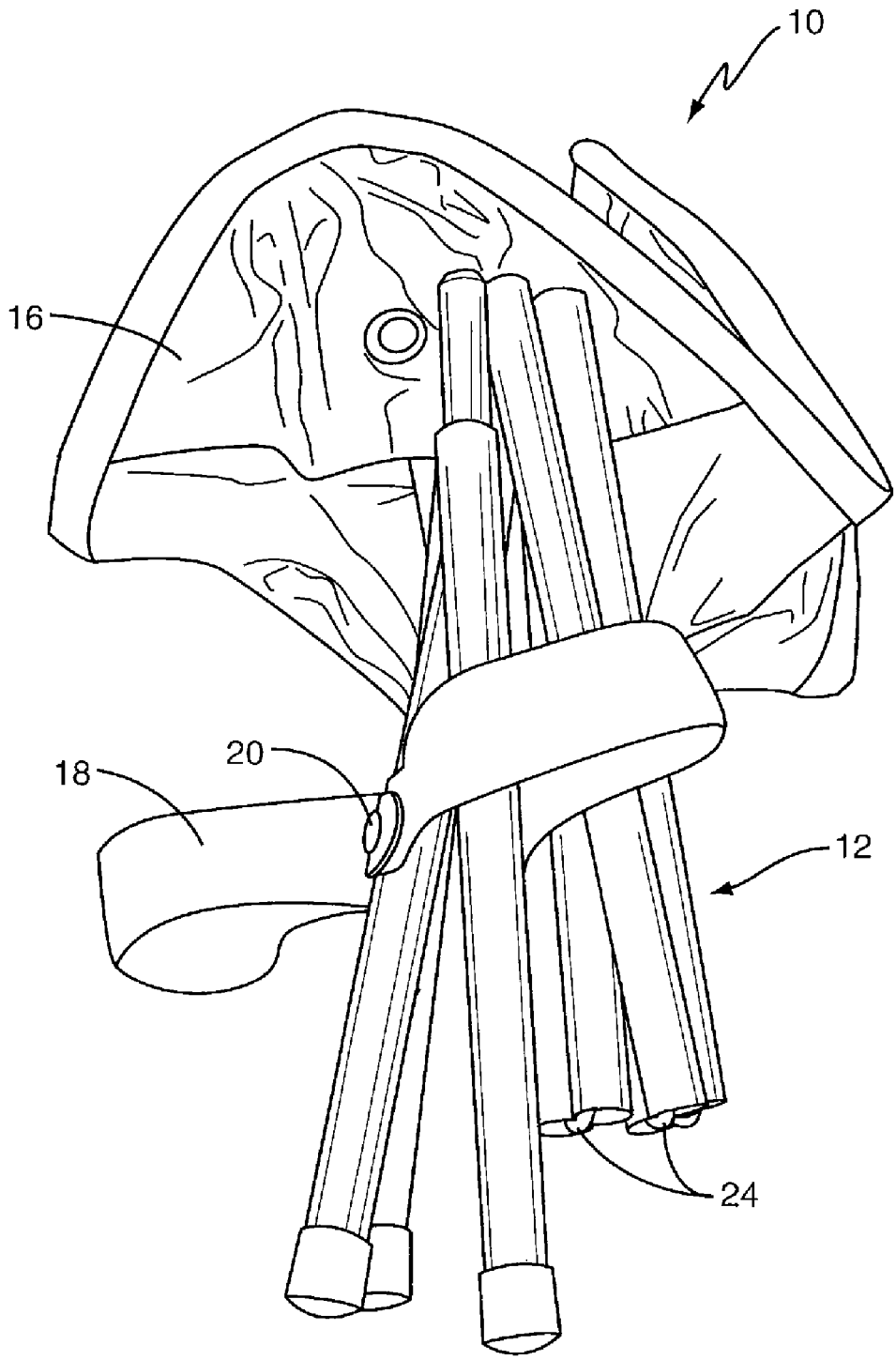
FIG. 3 illustrates a collapsible support frame according to one embodiment of the present invention in a folded position.

FIG. 3 illustrates the support frame 10 in the folded position. In this state, the individual segments 12*a-c* are generally aligned so that the entire support frame 10 forms a bundle. The elastic cord 24 stretches when the segments 12*a-c* are separated, but remains bound to the end caps 26 to hold the individual segments loosely together.

Figure 4:
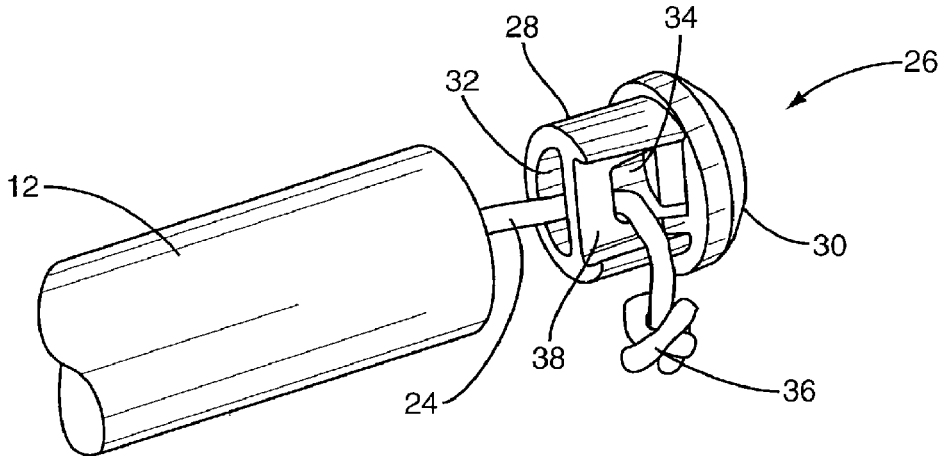
FIG. 4 illustrates an end cap used in one embodiment of the present invention.

FIG. 4 illustrates an end cap 26 suitable for use in one embodiment of the present invention. End cap 26 comprises a unitary member constructed having a body 28 and an enlarged head 30. The body 24 is sized to fit within an open end of a segment 12*a*, 12*c* and includes a channel 32 that receives an end of the elastic cord 24. The elastic cord 24 passes interiorly through the body 24 via the channel 32 and exits through an opening 34 formed in a sidewall of the body 24. To bind the elastic cord 24 to the end cap 26, a user may form a knot 36 in the end of the elastic cord 24. The knot 36 should be sized such that the elastic cord 24 does not pull back through the opening 34 under tension. The knot 36 may be disposed within a cutout area 38 formed in the sidewall of body 24 when the end cap 26 is connected to the segment 12*a* or 12*c*.

The head 30 comprises a generally arcuate surface. In this embodiment, head 30 is sized to have substantially the same or slightly greater circumference than the outer circumference of the tubular segment 12*a*, 12*c* to which it attaches. This prohibits the elastic cord 24, which is under tension, from pulling the end cap 26 within the segment 12*a*, 12*c*. The head 30 also functions as a foot that contacts the underlying ground surface to provide stability to the support frame 10.

Figure 5:
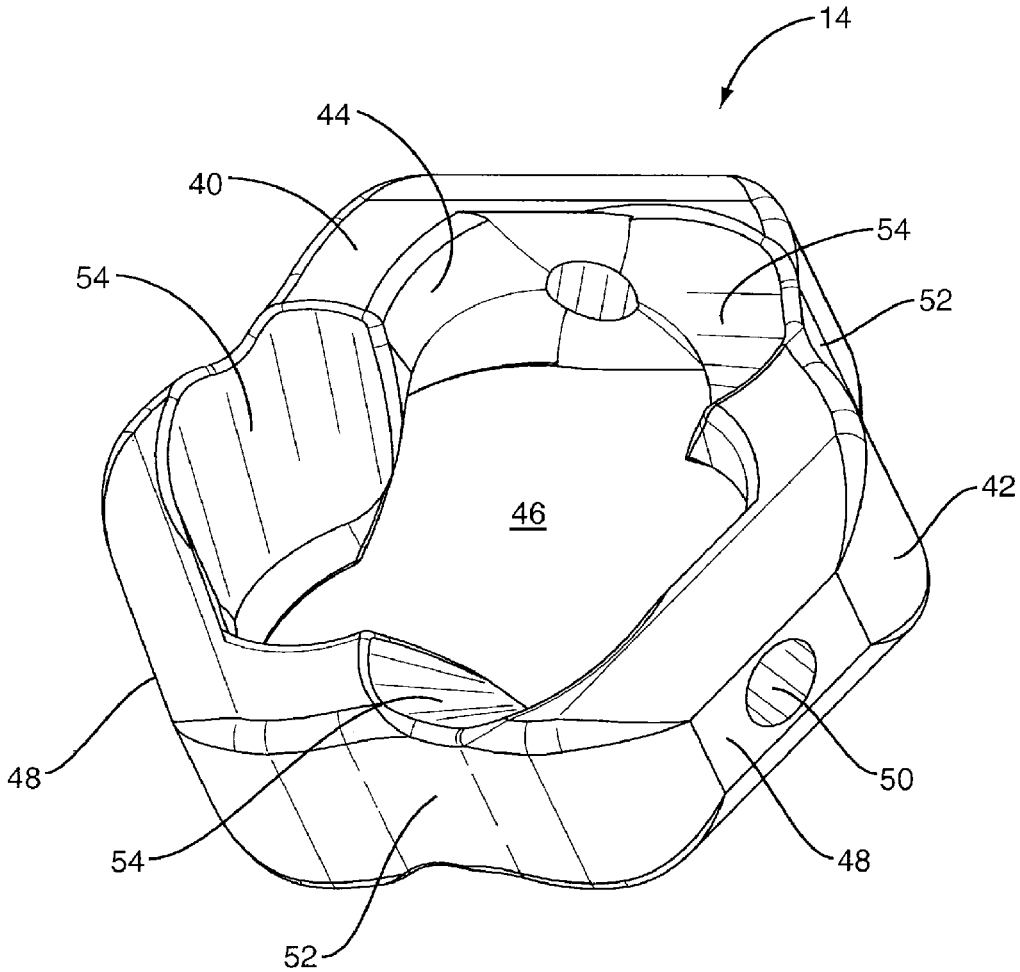
FIG. 5 illustrates a collar according to one embodiment of the present invention.

FIG. 5 illustrates one embodiment of the collar 14 that pivotably connects the legs 12. Collar 14 is a lightweight rigid, unitary member constructed of glass-filled nylon, metal, or metal alloy. Collar 14 comprises a sidewall 40 having an outer surface 42 and an inner surface 44. The sidewall 40 surrounds an opening 46 that receives the intermediate segments 12*b* of each leg 12. In this embodiment, the collar 14 has a generally triangular shape having cropped corners to create three substantially straight segments 48. In each straight segment 48, an opening 50 is formed that extends through the sidewall 40. Each opening 50 receives a mechanical fastener such as a rivet or screw that pivotably attaches the collar 14 to the legs 12. As described below in more detail, the legs 12 pivot within the opening 46 between the folded position and the deployed position.

The outer surface 42 is formed to include a concave outer leg seats 52 disposed between each straight segment 48. The outer leg seats 52 are shaped to generally conform to the contour of the tubular segments 12*a*, 12*c*. In the folded position, the segments 12*a*, 12*c* may fit within the outer leg seats 52. This aligns the segments 12*a*, 12*c* in generally the same direction, which facilitates maintaining the folded support frame 10 as compact as possible.

The inner surface 44 of the collar 14 comprises three contoured leg support seats 54; one for each leg 12. The leg support seats 54 contact and support the legs 12 when the support frame 10 is in the deployed position. Each leg support seat 54 comprises an angled surface that conforms to the shape of the leg segment 12*b*, and extends through the collar at a different angle. When the support frame 10 moves from the folded position to the deployed position, each leg segment 12*b* pivots about the mechanical fastener extending through opening 50 until it contacts the angled surface of a respective leg support seat 54. After contacting the angled surface, each leg 12 will extend in a different direction supported by a leg support seat 54.

The leg support seats 54 may be formed using any means known in the art. By way of example, the leg support seats 54 may be formed by drilling or milling a block of material. Alternatively, the entire collar 14 may be formed by casting or molding.

Figure 6:
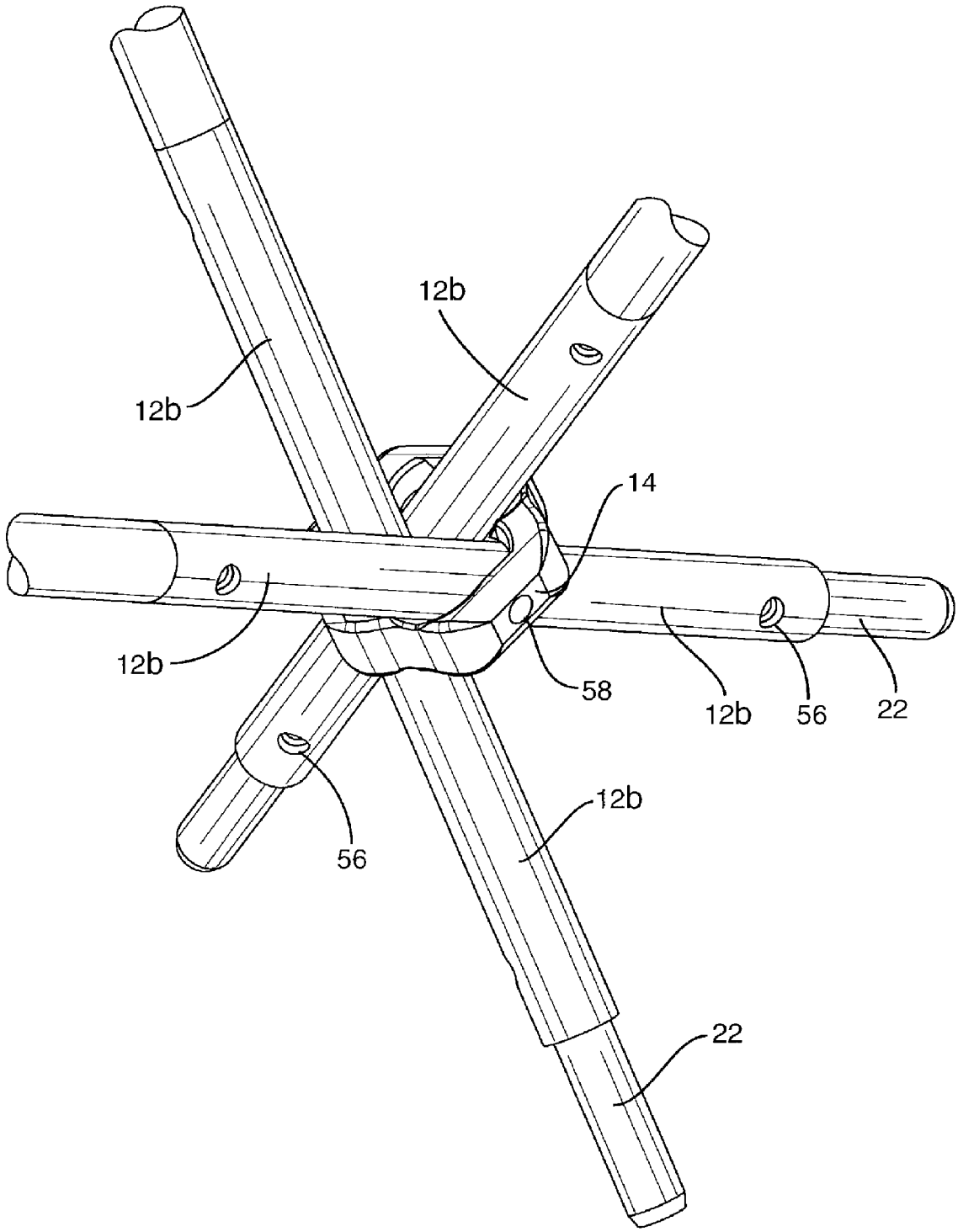
FIG. 6 illustrates the collar of FIG. 5 connected to the legs of the collapsible support frame according to one embodiment of the present invention.

FIG. 6 is a close-up view of how the collar 14 might attach to the legs 12 according to one embodiment. As seen in FIG. 6, each intermediate segment 12*b* comprises one or more holes 56 formed in its sidewall. A mechanical fastener 58 such as a rivet or bolt, for example, passes through the opening 50 and into a selected hole 56. Each segment 12*b* thus pivotably attaches to the inner surface 44 of collar 14, but not to each other. This permits the legs 12 to pivot about the mechanical fastener 58 between the folded position and the deployed position.

Figure 7:
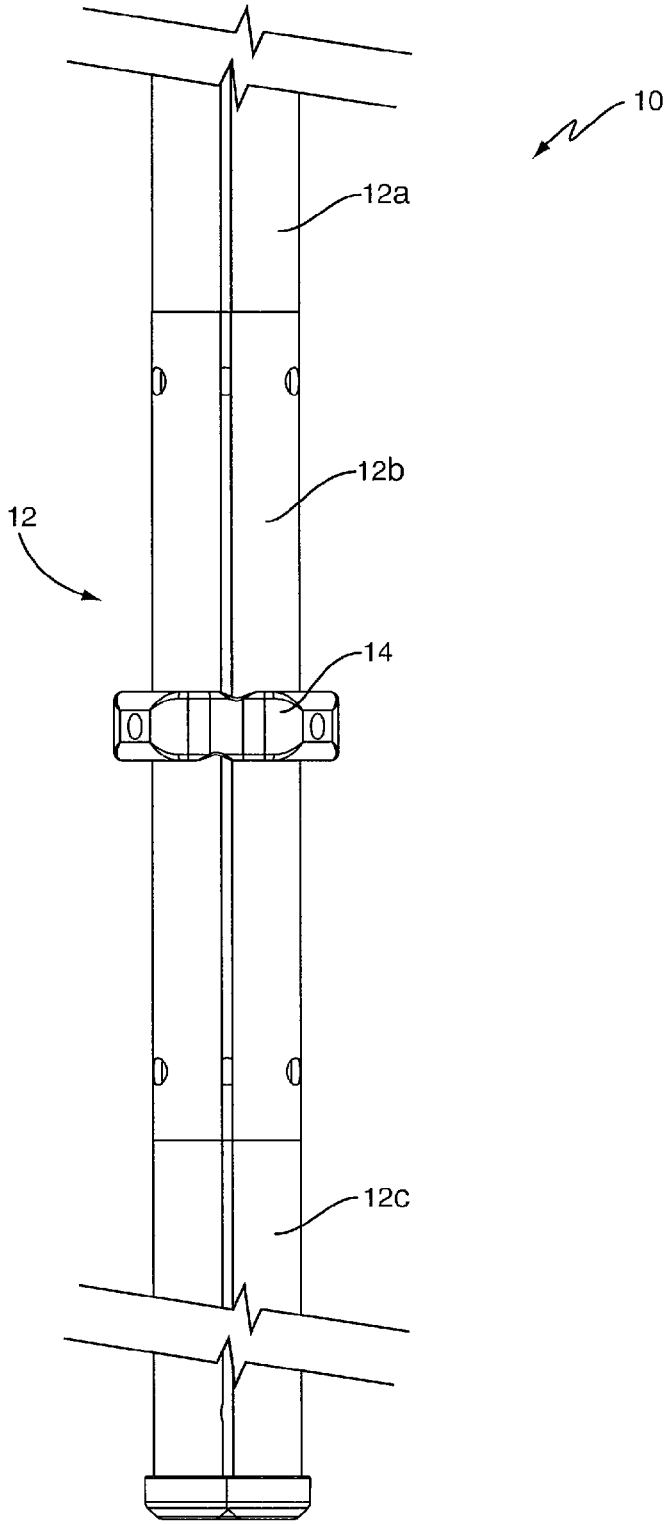
FIG. 7 illustrates the legs of the collapsible support frame aligned in a generally parallel configuration.

To place the support frame in the folded position, a user pivots the legs 12 such that the legs 12 are generally parallel to each other (FIG. 7), separates the leg segments 12*a-c* for each leg 12, and folds the leg segments 12*a-c* into a bundle as shown in FIG. 3. The bundle may be secured with a strap that extends around the folded leg segments 12*a-c*. To deploy the support frame 10, the user removes the strap from around the folded leg segments 12*a-c*, aligns the leg segments 12*a-c* so that the tension in the elastic cord 24 pulls the segments 12*a-c* together, and pivots the legs 12 to the deployed position (FIG. 6). As the legs 12 pivot, the legs 12 open to deploy the seat 16 and the flexible straps 18 to an extended position.

It should be noted that the above embodiments describe the legs 12 as comprising three segments 12*a-c*; however, those skilled in the art will appreciate that more or fewer segments may be employed as needed or desired. In addition, the segments 12*a-c* need not be circular in cross-section, but may be any shape desired. The collar 14 would be formed such that the outer leg seats 52 and/or the leg support seats 54 conform to the shape of the leg segments 12*a-c*.

Figure 8:
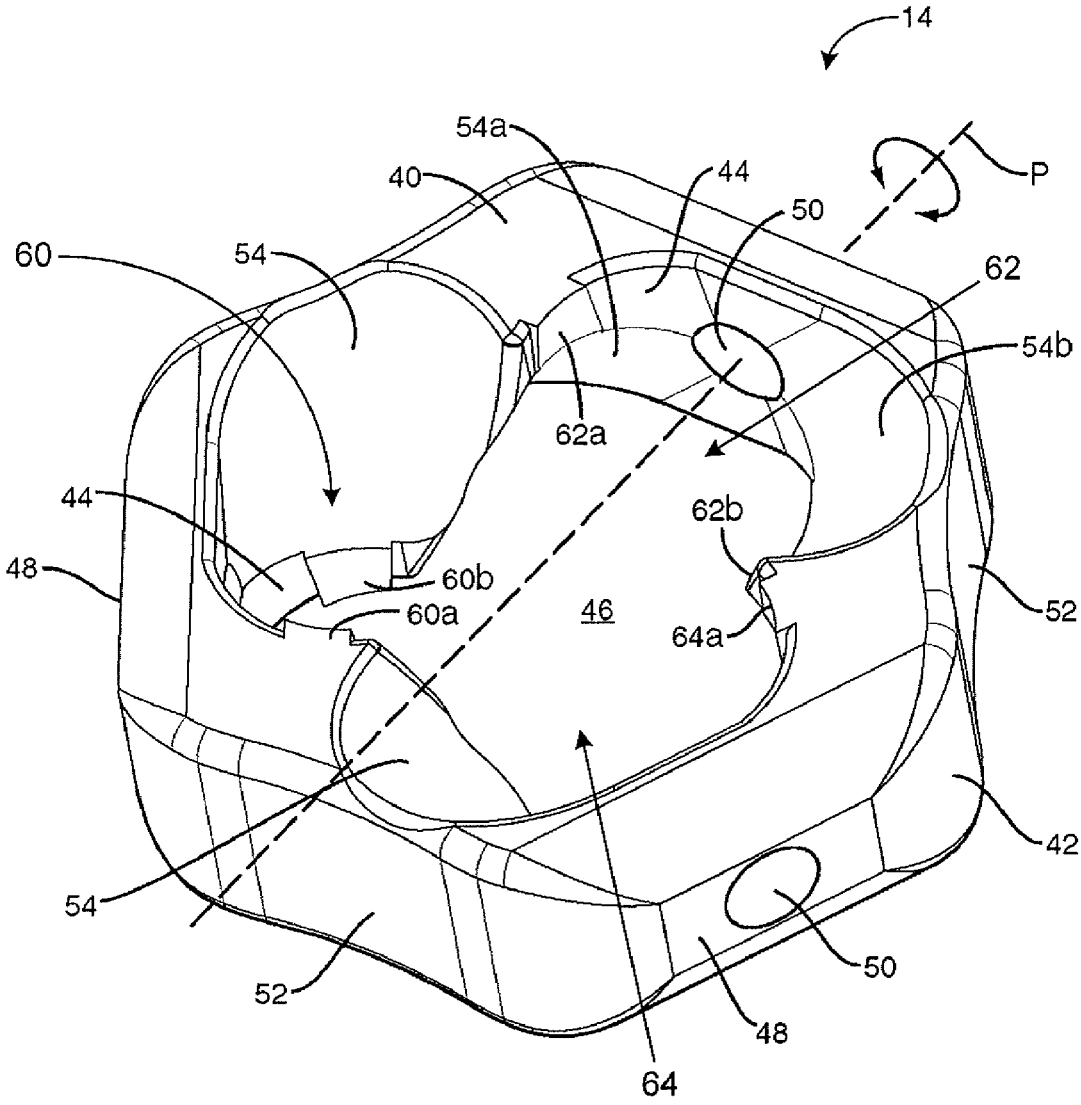
FIG. 8 illustrates a collar according to another embodiment of the present invention.

FIG. 8 illustrates another embodiment of the collar 14 that pivotably connects the legs 12. As in the previous embodiment, mechanical fasteners extend through the openings 50 and attach to the legs 12 such that legs 12 pivot about respective pivot axes between the folded position and the deployed position. In this embodiment, collar 14 includes a plurality of stops 60, 62, 64 integrally formed as projections on the inner surface 44 of the collar 14. The stops 60, 62, 64 are positioned to allow the legs 12 to pivot to their deployed positions in which they contact their respective leg support seats 54, and to prevent the legs 12 from moving past a predetermined point when they move to the folded position.

In this embodiment, the stops 60, 62, and 64 are formed in pairs with each stop projecting from the inner surface 44 adjacent a respective leg support seat 54. For example, stop 62 comprises a first stop 62*a* and a second stop 62*b*. The first stop 62*a* is integrally formed with the inner surface 44 adjacent leg support seat 54*a* such that it is positioned on one side of a corresponding leg 12. The second stop 62*b* is integrally formed with the inner surface 44 adjacent a corresponding leg seat 54*b* such that it is positioned on the other side of the leg 12. Additionally, the first and second stops 62*a*, 62*b* are also formed such that one stop 62*a* lies above the pivot axis p and the other stop 62*b* lies below the pivot axis p. This placement of the stops 62 prevents the over-rotation of their corresponding legs 12 when they move to the folded position.

Figure 9:
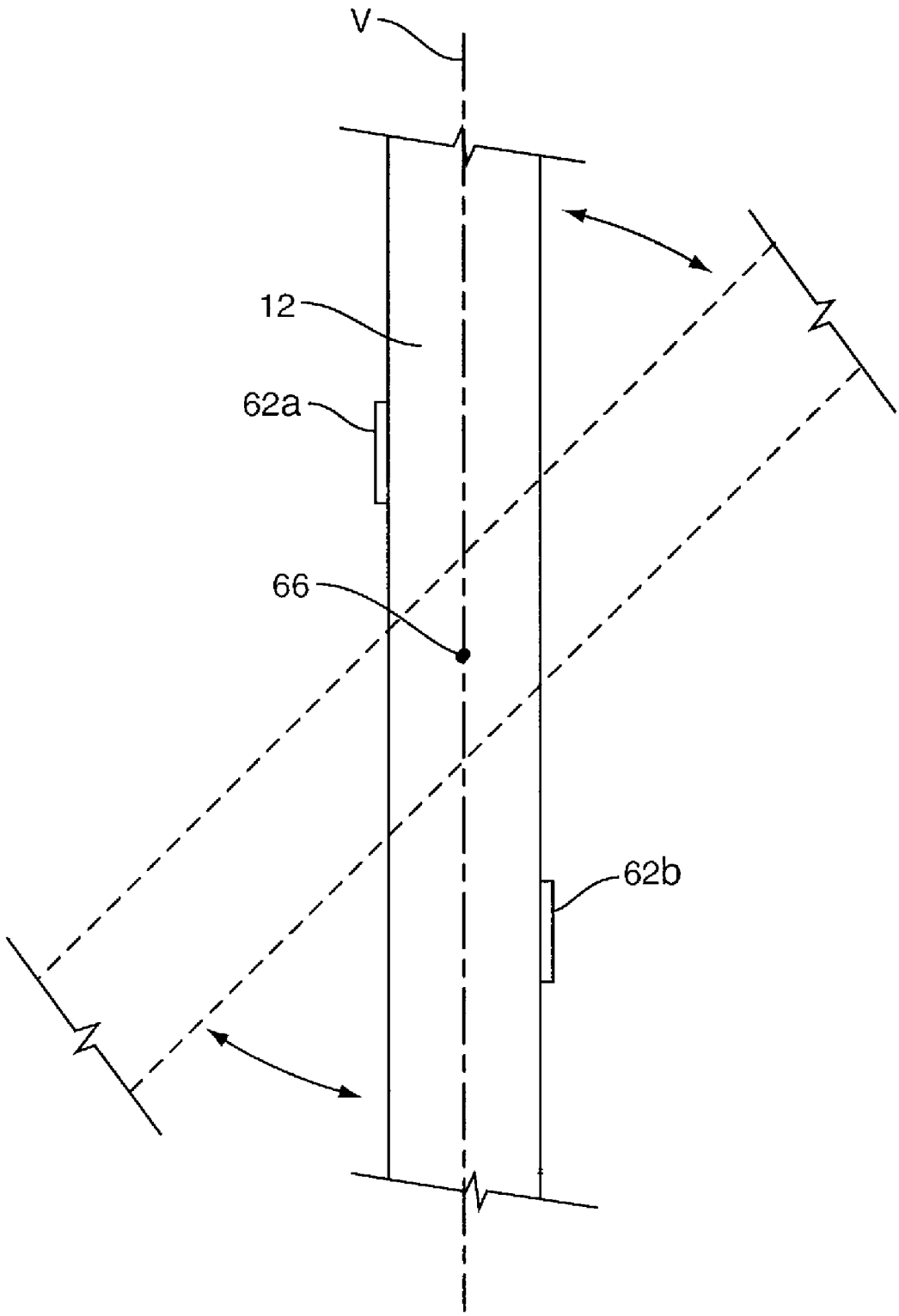
FIG. 9 is a cross-sectional view illustrating how the stops limit the pivoting movement of a leg according to one embodiment of the present invention.

FIG. 9 illustrates a cross section of stops 62 as they function relative to a single leg 12. As seen in FIG. 9, leg 12 pivots about a point 66 that lies along the pivot axis p. The stops 62 allow the leg 12 to move away from the stops 62 to the deployed position, shown here in dotted relief. However, the stops 62 prevent the leg 12 from moving past a predetermined point in the folded position. Particularly, the stops 62 are sized to space the leg 12 away from the inner surface 44 when in the folded position. Therefore, leg 12 ceases to pivot towards the folded position upon contacting stops 62*a*, 62*b*. In this embodiment, the stops 62 prevent the leg 12 from moving beyond a vertical axis v; however, those skilled in the art will appreciate that this is for illustrative purposes only. The stops 62 may be any size to prevent the leg 12 from pivoting beyond any desired point.

Those skilled in the art will recognize that the collapsible stool described herein represents only one exemplary embodiment of the present invention. The support frame 10 that is the basis for the collapsible stool can be also used in an almost endless variety of structures. Such structures include, but are not limited to, chairs and tables. Further, one of the embodiments illustrates pairs of stops formed on the inner surface of the collar. However, pairs of stops are not required and the present invention may comprise collars having only a single stop.

Therefore, the present invention may be carried out in ways other than those specifically set forth herein without departing from essential characteristics of the invention. The present embodiments are to be considered in all respects as illustrative and not restrictive, and all changes coming within the meaning and equivalency range of the appended claims are intended to be embraced therein.

What is claimed is:

1. A collapsible frame structure comprising:

a collar having a sidewall that surrounds a central opening, the sidewall including an inner surface and an outer surface;

a plurality of legs, each leg extending through the central opening and pivotally attached to the inner surface of the collar to be movable between a folded position and an deployed position;

contoured leg support seats formed in the inner surface of the collar to contact and support the legs in the deployed position; and a plurality of stops formed on the inner surface of the collar to contact a leg when the leg pivots to the folded position to prevent the leg from pivoting beyond a predetermined point within the central opening when the leg moves to the folded position.

2. The frame structure of claim 1 wherein the plurality of stops comprise first and second projections integrally formed on the inner surface of the collar and adjacent the contoured leg support seats.

3. The frame structure of claim 2 wherein the first and second projections are formed on opposite sides of a leg above and below a pivot axis about which the leg pivots between the folded position and the deployed position.

4. The frame structure of claim 1 wherein the plurality of stops project from the inner surface of the collar and are sized to space the leg away from the inner surface of the collar when the legs are in the folded position.

5. The frame structure of claim 4 wherein the plurality of stops are contoured to the shape of the legs.

6. The frame structure of claim 1 wherein the contoured leg support seats comprise angled surfaces that receive the legs in the deployed position.

7. The frame structure of claim 6 wherein the contoured leg support seats conform to the shape of the legs.

8. The frame structure of claim 1 wherein each leg comprises a plurality of interconnecting segments.

9. The frame structure of claim 8 further comprising an elastic cord extending interiorly through the segments to pull the segments together when the legs move to the deployed position.

10. The frame structure of claim 9 further comprising contoured leg seats formed in the outer surface of the collar to contact one or more of the interconnecting segments when the legs are disassembled in the folded position.

11. A collapsible frame structure comprising:

a collar having a sidewall that surrounds a central opening, the sidewall including an inner surface and an outer surface;

a plurality of legs, each leg extending through the central opening and pivotally attached to the inner surface of the collar to be movable between a folded position and an deployed position; and a plurality of stops formed on the inner surface of the collar to contact a leg when the leg pivots to the folded position to prevent the leg from pivoting beyond a predetermined point within the central opening when the leg moves to the folded position.

12. The frame structure of claim 11 further comprising contoured leg seats formed in the outer surface of the collar to contact one or more interconnecting segments of the legs when the legs are disassembled in the folded position.

13. The frame structure of claim 11 further comprising a flexible seat attached to the legs, and a flexible strap attached to the legs.

14. The frame structure of claim 11 further comprising contoured leg support seats formed in the inner surface of the collar to contact and support the legs in the deployed position.

15. The frame structure of claim 14 wherein the contoured leg support seats comprise angled support seats that receive the legs in the deployed position.

16. The frame structure of claim 11 wherein the stop comprises first and second members integrally formed on the inner surface of the collar.

17. The frame structure of claim 16 wherein the first and second stops are formed on opposite sides of a leg above and below a pivot axis about which the leg pivots between the folded position and the deployed position.

18. The frame structure of claim 11 wherein the plurality of stops project from the inner surface of the collar and are sized to space the leg away from the inner surface of the collar when the legs are in the folded position.

19. The frame structure of claim 18 wherein the plurality of stops are contoured to the shape of the legs.

* * * * *